US007167813B2

(12) United States Patent
Chian et al.

(10) Patent No.: US 7,167,813 B2
(45) Date of Patent: Jan. 23, 2007

(54) WATER HEATER PERFORMANCE MONITORING SYSTEM

(75) Inventors: Brent Chian, Plymouth, MN (US); Bruce L. Hill, Roseville, MN (US); Timothy J. Nordberg, Bloomington, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/048,023

(22) Filed: Jan. 31, 2005

(65) Prior Publication Data

US 2006/0173653 A1 Aug. 3, 2006

(51) Int. Cl.
*F24H 9/20* (2006.01)
*F22B 37/42* (2006.01)

(52) U.S. Cl. ..... 702/183; 702/136; 122/14.22; 122/504.2; 340/589

(58) Field of Classification Search ..... 702/50, 702/99, 127, 130, 132–136, 182; 122/14.22, 122/447, 450, 504, 504.2, 14.1
See application file for complete search history.

(56) References Cited

U.S. PATENT DOCUMENTS

| | | | | |
|---|---|---|---|---|
| 5,684,717 | A * | 11/1997 | Beilfuss et al. | 702/185 |
| 6,236,321 | B1 * | 5/2001 | Troost, IV | 340/588 |
| 6,265,699 | B1 | 7/2001 | Scott | 219/483 |
| 6,308,009 | B1 | 10/2001 | Shellenberger et al. | 392/454 |

* cited by examiner

*Primary Examiner*—Marc S. Hoff
*Assistant Examiner*—Manuel L Barbee

(57) ABSTRACT

A water heater performance monitoring device for monitoring whether a water heater is functioning optimally or whether it requires service. The device uses maximum heating rates taken from a plurality of measured heating rates to determine if the performance of the water heater has degraded from a threshold performance level. A water heater performance monitoring device can reduce the number of false alarms that occur regarding the need for water heater service by filtering out temporary factors, lasting less than a time cycle, which affect heating rate of water in the water heater. This can save users time and money by reducing unnecessary water heater inspections.

27 Claims, 5 Drawing Sheets

WATER HEATER PERFORMANCE MONITORING SYSTEM

BACKGROUND

1. Field of the Invention

The present invention relates in general to water heater performance monitoring and, more particularly, to a system and method for using water heating rates to determine whether a water heater is functioning optimally.

2. Description of Related Art

Gas water heaters are typically constructed with a burner to heat water stored in a water tank. The burner is typically located directly below the water tank, and transfers heat to the water in the water tank via conduction through the water tank bottom. Problems with a water heater can impede this transfer of heat to the water in various ways (e.g., sediment buildup inside the water tank, defects in the manufacture of the water heater, misassembly of the water heater, damage to the water heater), thus slowing down the rate at which the water is heated. Such a reduction in the rate of heat transfer can undesirably affect the efficiency of the water heater, resulting in higher fuel usage and decreased water heating capability.

To address the problem of reduced heat transfer rates between the burner and the water in the water tank of a water heater, detection and warning systems have been used. For instance, in U.S. Pat. No. 6,265,699 B1 (the '699 patent), an electronic control for an electric water heater measures heating rates of water near electric heating elements of the water heater and, when the heating rate falls below a threshold level, sends an error indication to a user. Such an approach, however, can falsely identify or fail to identify problems with the operation of the water heater. By way of example, the control described in the '699 patent would send an error indication to a user after a single heating cycle having a heating rate below a threshold level. The fact that the device in the '699 patent relies on a single heating cycle to determine whether the water heater is functioning properly would likely result in a substantial number of false alarms due to normal fluctuations in heating rate from one heating cycle to the next.

Additionally, the '699 patent uses a preprogrammed threshold heating rate to determine whether the water heater is functioning properly. Such a preprogrammed threshold heating rate does not account for variations in heating rates between different water heaters, nor does it account for variations in the different environments in which water heaters may be installed. Consequently, it would be desirable to have a gas water heater performance monitoring system and method that filters out the effects of at least some external and/or short-term factors in determining when to alert a user that the water heater requires service.

SUMMARY

An exemplary embodiment provides a performance monitoring device for a water heater. The performance monitoring device is comprised of a processing unit; a temperature sensing apparatus; at least one output device; data storage; a threshold heating rate stored in the data storage; maximum heating rate data stored in the data storage, the maximum heating rate data defining (from a plurality of calculated heating rates for the water heater) a maximum heating rate for a predefined operation period; and monitoring logic stored in the data storage and executable by the processing unit (i) to monitor the heating rate of water in the water heater, (ii) to determine when the performance of the water heater has degraded, and (iii) in response to a determination of degradation in performance, to notify a user of the water heater of the degradation. The performance monitoring device makes the determination when the performance of the water has been degraded, in part, by comparing the maximum heating rate to the threshold heating rate.

These as well as other aspects and advantages of the present invention will become apparent to those of ordinary skill in the art by reading the following detailed description, with appropriate reference to the accompanying drawings.

BRIEF DESCRIPTION OF THE DRAWINGS

An exemplary embodiment of the present invention is described herein with reference to the following drawings, wherein.

DETAILED DESCRIPTION

In view of the wide variety of embodiments to which the principles of the present invention can be applied, it should be understood that the illustrated embodiments are exemplary only, and should not be taken as limiting the scope of the present invention.

Figure 1:
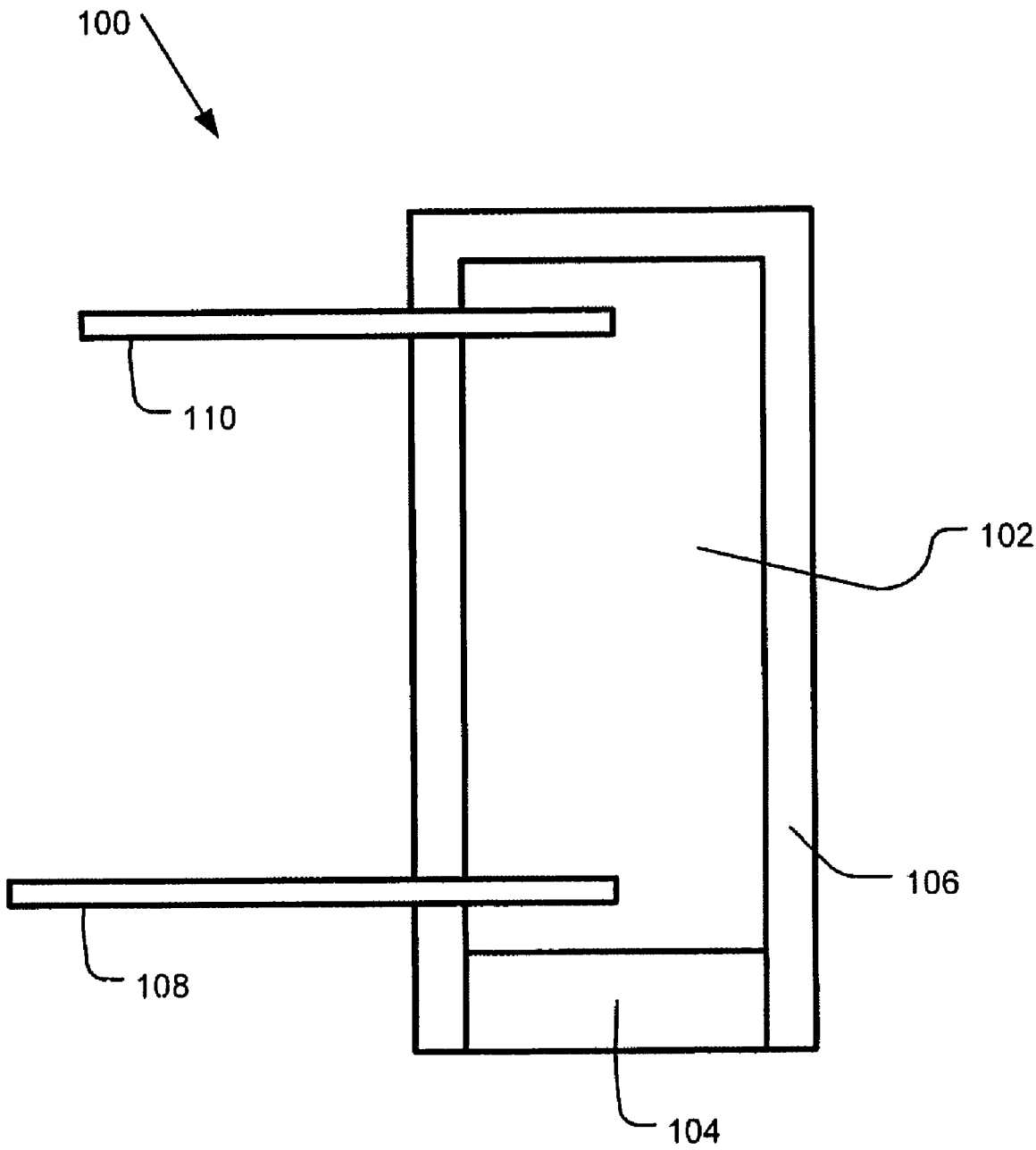
FIG. 1 is a simplified cross-sectional diagram illustrating components of a typical gas water heater that may be used in accordance with the exemplary embodiment.

FIG. 1 is a simplified cross-sectional diagram of a typical gas water heater 100 for use in accordance with an exemplary embodiment of the present invention. As illustrated, the gas water heater 100 includes a water tank 102, a burner 104 below the water tank 102, insulation 106, a water inlet pipe 108, and a water outlet pipe 110. Other types of gas water heaters are also possible.

Figure 2:
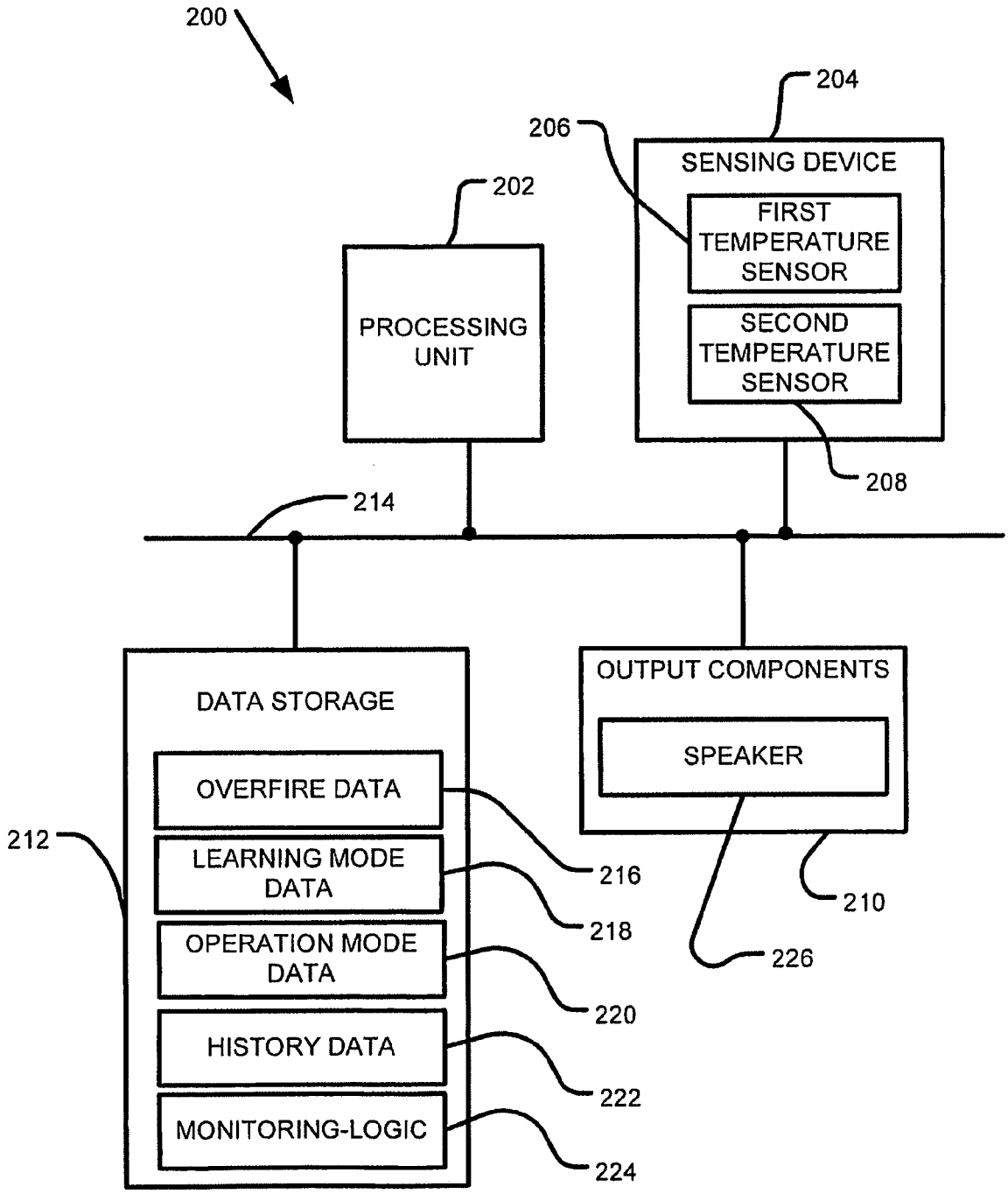
FIG. 2 is a block diagram illustrating components of an exemplary performance monitoring device in accordance with the exemplary embodiment.

FIG. 2 is a block diagram of a performance monitoring device 200 in accordance with an exemplary embodiment of the present invention. As shown in FIG. 2, the performance monitoring device 200 includes a processing unit 202; a sensing device 204, including a first temperature sensor 206 and a second temperature sensor 208; output components 210; and data storage 212, all coupled to at least one bus, illustrated as bus 214. In the exemplary embodiment, the data storage 212 stores data, including overfire data 216, learning mode data 218, operation mode data 220, and history data 222, as well as computer instructions, including monitoring logic 224, executable by the processing unit 202.

The processing unit 202 may be one or more processors, such as a general-purpose processor and/or a digital signal processor. Other types of processors are also possible.

The first and second temperature sensors 206 and 208 may be surface mount temperature sensors, such as thermistors, thermocouples, and/or resistance temperature sensors. Other types and/or combinations of surface mount and non-surface mount temperature sensors are also possible. Additionally, more or fewer temperature sensors are possible.

The output components 210 allow the performance monitoring device to communicate with a user of a water heater by, for instance, warning the user when the water heater is not functioning properly. As such, the output device 210 may include a speaker 226, as illustrated in FIG. 2. The performance monitoring device 200 may also comprise alternative and/or additional output components (e.g., a liquid crystal display (LCD) or a light emitting diode (LED)) not shown in FIG. 2.

Data storage 212 may be any medium or media readable by the processing unit 202, such as solid-state memory, magnetic discs, optical discs, and/or any other volatile and/or non-volatile data storage system. The data storage 212 may be used to store data and/or machine-readable instructions to be read and/or executed by the processing unit 202.

The stored overfire data 216 shown in FIG. 2 can define the maximum overfire threshold heating rate for the water heater.

The learning mode data 218 can store one or more copies of the maximum calculated heating rates (discussed in detail below) for the water heater during learning mode. The reason to keep the maximum heating rate is that, during the heating time, the heating rate may not be at or close to the expected heating rate if hot water is being taken out from the tank. However, during a relatively long period of time, such as two weeks, unless the hot water is drawn continuously, the heating rate will at times be detected at or close to the maximum. Redundant copies of the maximum rate can be stored for a data integrity check.

The operation mode data 220 can be a running maximum of heating rates for the water heater 100, calculated during an operation mode (discussed in detail below) during a relatively long operation time period, such as two weeks.

The history data 222, shown in FIG. 2, can define the maximum calculated heating rates for each operating mode time cycle. The history data 222 may be a table having one row and a plurality of columns resulting in a number of cells equal to the typical number of time cycles in a calendar year. For example, for a two-week operating mode time cycle, the history data 222 table would generally have twenty-six cells.

The stored monitoring logic 224 shown in FIG. 2 may contain instructions for operation of the performance monitoring device 200. The monitoring logic 224 can include instructions for, among other things, measuring the water temperature at a first time using the first and/or second temperature sensors 206 and 208, and a second time using the first and/or second temperature sensors 206 and 208; calculating a water heating rate using the measured water temperatures; comparing a calculated heating rate to an overfire heating rate; determining if the performance monitoring device 200 is in learning mode or operation mode; storing the calculated heating rate in the data storage 212; calculating an average heating rate using the stored heating rates; determining whether a data table is full; determining the highest heating rate from a plurality of stored heating rates; and comparing a calculated heating rate to a threshold heating rate. The monitoring logic 224 may additionally contain instructions for determining whether to apply ambient temperature compensation (discussed in detail below), and if so, to what extent it should be applied. Other instructions are also possible.

Although the performance monitoring device 200 is shown as a single physical device in FIG. 2, the various components of the apparatus 200 could also be separate, discrete devices in direct or indirect (i.e. via one or more intermediate devices) communication, either wirelessly or otherwise. Additional or fewer performance monitoring device components are possible as well.

Figure 3:
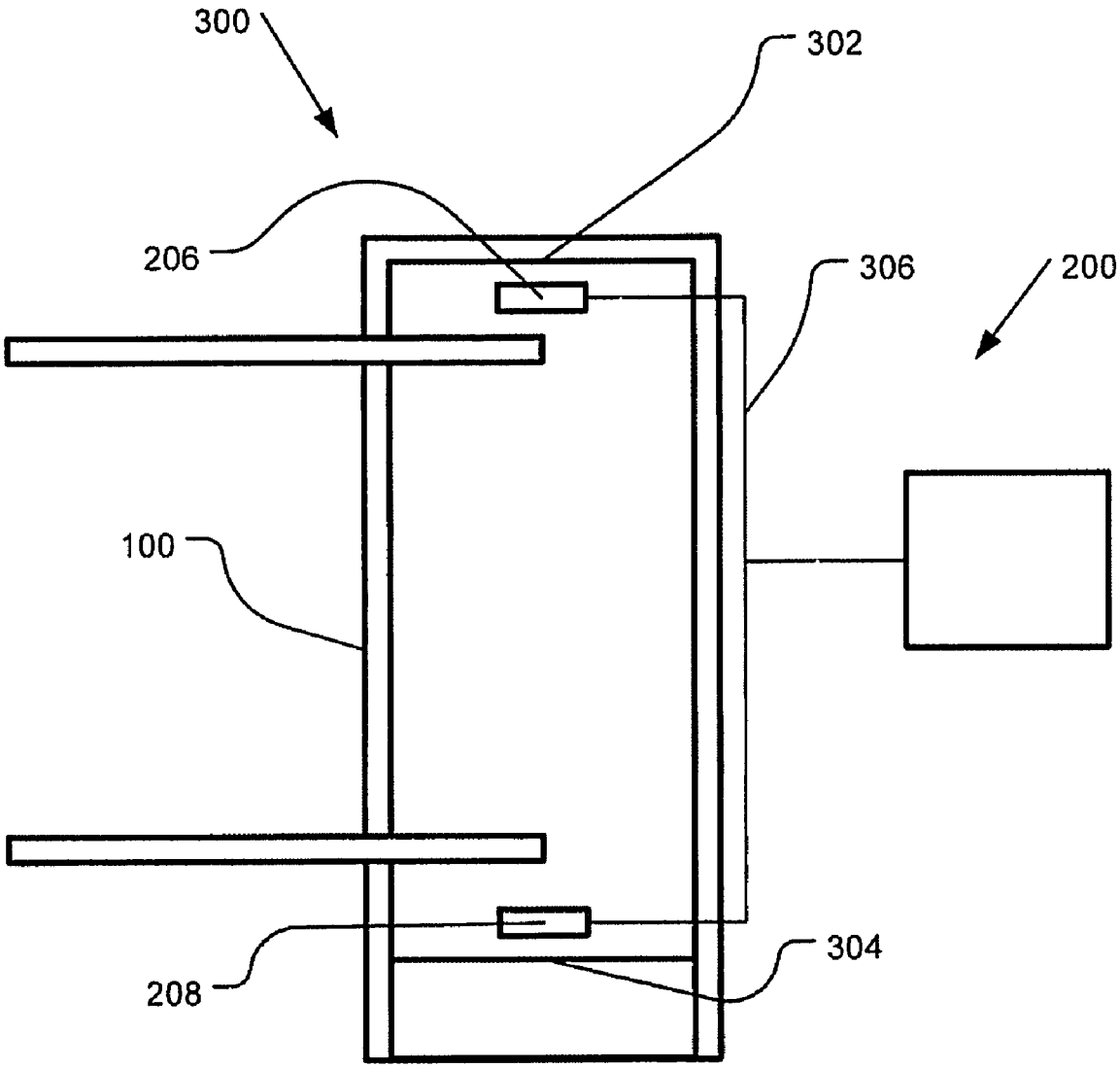
FIG. 3 is a simplified cross-sectional diagram illustrating components of an exemplary performance monitoring system in accordance with the exemplary embodiment.

FIG. 3 is a simplified cross-sectional diagram of a water heater performance monitoring system 300 in accordance with an exemplary embodiment of the present invention. As shown in FIG. 3, the water heater performance monitoring system 300 includes the water heater 100 of FIG. 1 and the performance monitoring device 200 of FIG. 2. As shown in FIG. 3, the first temperature sensor 206 of the performance monitoring device 200 is mounted on the outer side surface of the water heater tank, inside the insulator layer, near the water tank top 302, and the second temperature sensor 208 of the performance monitoring device is mounted on the outer side surface of the water heater tank, inside the insulator layer, near the water tank bottom 304. In the exemplary embodiment shown in FIG. 3, the first and second temperature sensors 206 and 208 are communicatively coupled to the remaining components of the performance monitoring device 200 via insulated wires 306. Other types of communicative coupling such as fiber optics or radio frequency (RF) wireless communication, for instance, are also possible.

Figure 4A:
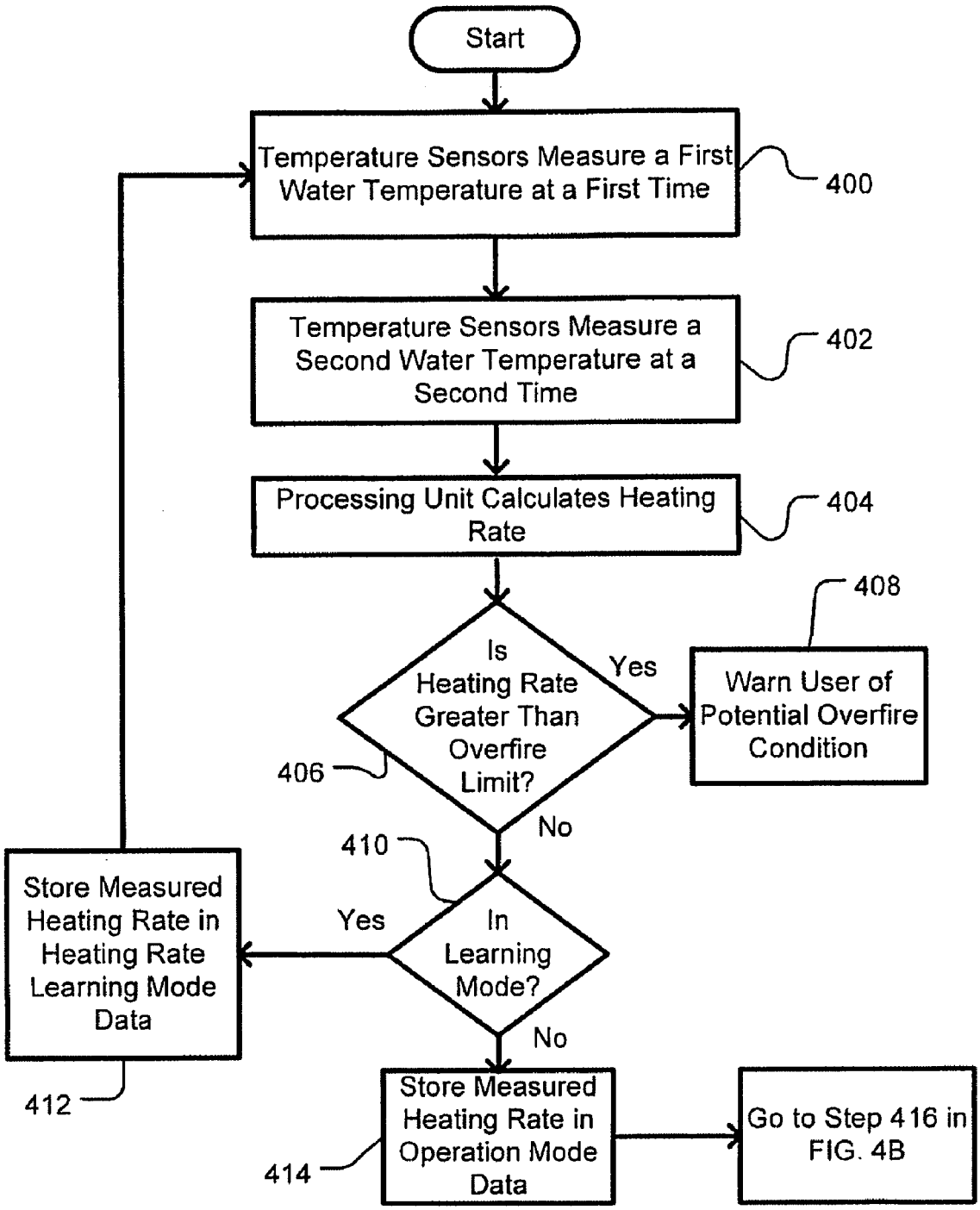
FIGS. 4A and 4B are flowcharts illustrating a functional process flow in accordance with the exemplary embodiment.
Figure 4B:
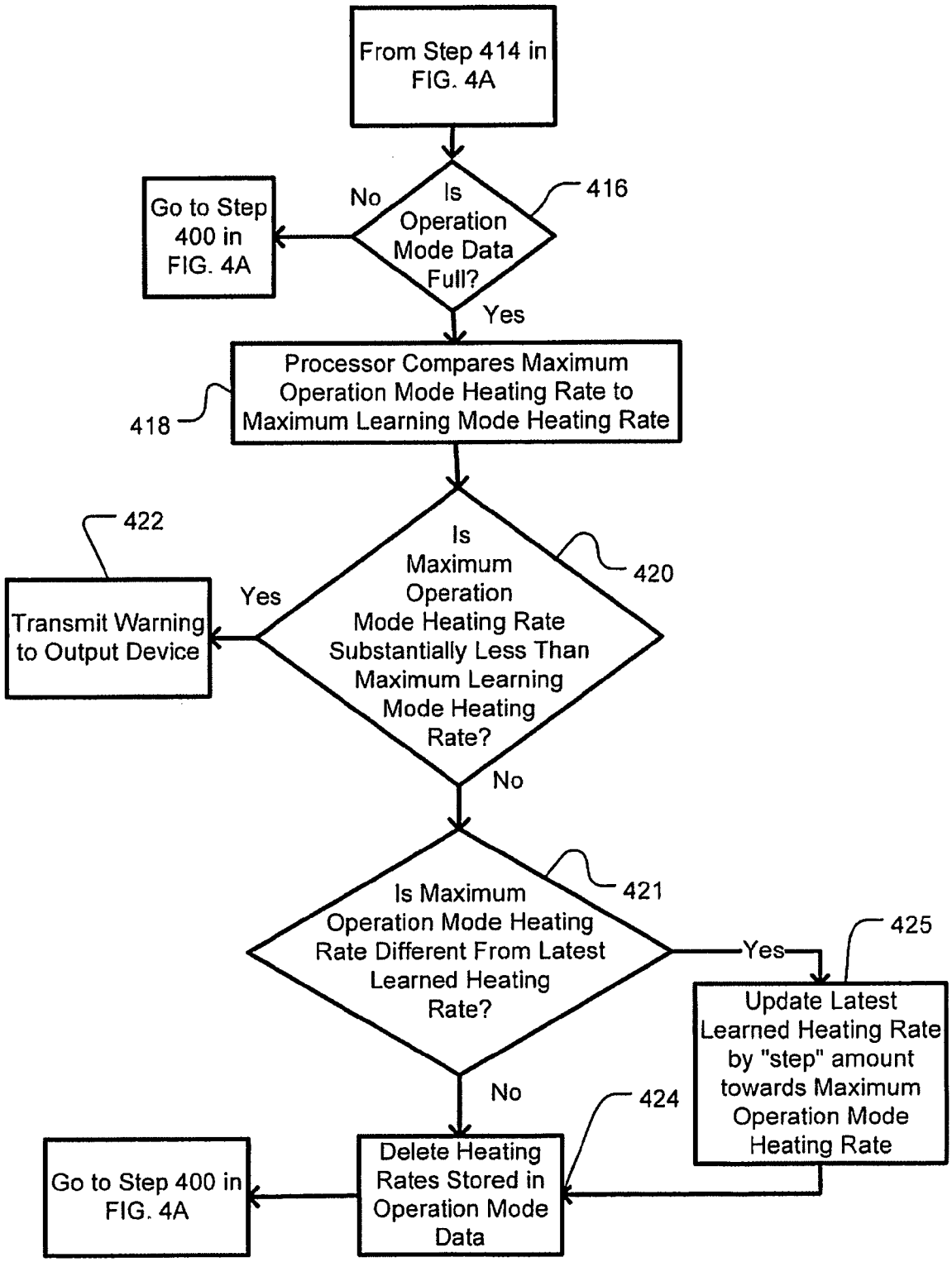

FIGS. 4A and 4B are flow charts that illustrate exemplary functions performed by the performance monitoring device 200 in accordance with an exemplary embodiment of the present invention. At step 400, the first and second temperature sensors 206 and 208 measure the temperature of the water in the water tank 102 at a first time. Next, at step 402, the temperature sensors 206 and 208 measure the water temperature at a second time, after a predefined delay from the first time. In an exemplary embodiment, the predefined delay period is preferably one minute; however, the delay period could be any period of time shorter than a typical heating cycle for the water heater 100. In alternative embodiments, more or fewer temperature sensors may be used.

At step 404, after the temperature sensors 206 and 208 have measured the second water temperature in step 402, the processing unit 202 calculates the heating rate for that moment of the water heater 100. The processing unit 202 can do this by subtracting the first measured water temperature from the second measured water temperature, and then dividing the result by the predefined time (e.g., one minute). If multiple temperature sensors were used to measure water temperature, the value for water temperature used to calculate the heating rate may be the average of the water temperatures measured at the first and second temperature sensors 206 and 208 at that time. Alternatively, only one of the measured temperatures may be used to calculate the heating rate. Next, at step 406, the processing unit determines whether the calculated heating rate is greater than an overfire preprogrammed threshold. The processing unit 202 can do this by comparing the measured heating rate to the overfire threshold heating rate stored in the overfire data 216. If the calculated heating rate is greater than the threshold heating rate stored in the overfire data 216, the performance monitoring device 200 warns the user of the water heater performance monitoring system 300 of a possible overfire condition, at step 408. The monitoring device 200 can do this by using at least one of its output components 210, such as the speaker 226. An overfire condition may be caused by, among other things, an empty or partly empty water tank, high gas pressure, installation of incorrect burner components, or other part defects and/or assembly errors.

If the measured heating rate is not greater than the overfire preset limit, the processing unit 202 determines, at step 410, whether the performance monitoring device 200 is in a learning mode. The performance monitoring device's 200 learning mode operates for a period after the water heater 100 begins to operate. The learning mode allows the performance monitoring device 200 to obtain an accurate maximum heating rate for that particular water heater 100 installed in its particular environment. Additionally, the learning mode permits exclusion of transitory factors that might alter the maximum heating rate of the water heater 100 as long as the transitory factors last for a shorter time than the learning period. The processing unit 202 can determine if the performance monitoring device 200 is in learning mode by reviewing the learning mode data 218. Specifically, if the learning mode data 218 has any empty cells, the performance monitoring device 200 is in the learning mode, if the learning mode data 218 does not have empty cells, the performance monitoring device 200 is not in the learning mode. If the processing unit 202 determines that the performance monitoring device 200 is in the learning mode, the processing unit 202, at step 412, causes the measured heating rate to be stored in the learning mode data 218. The process then starts over at step 400.

If, at step 410, the processing unit 202 determines that the performance monitoring device 200 is not in learning mode, the processing unit 202 causes the determined heating rate to be stored in the operation mode data 220, at step 414. Next, at step 416 of FIG. 4B, the processor determines whether all of the cells of the operation mode data 220 are full. If they are not, the process returns to step 400 of FIG. 4A. However, if all of the cells of the operation mode data 220 are full, the processor, at step 418, compares the highest heating rate stored in operation mode data 220, the "maximum operation mode heating rate," to the highest heating rate stored in the learning mode data 218, the "maximum learning mode heating rate." In making that comparison in step 418, if the processor 202 determines in step 420 that the maximum operation mode heating rate is substantially less than the maximum learning mode heating rate, or if the historical data shows a significant declining trend in water heater performance, the processor 202 causes the performance monitoring device 200 to transmit a warning to a user of the water heater 100 in step 422. The warning of step 422 informs the user of the degradation of water heater 100 performance. The monitoring device 200 can provide the warning using at least one of its output components 210, such as the speaker 226. The warning can include, for example, a recommendation that the user contact a water heater professional repair service to determine whether the water heater 100 requires maintenance or repair. In an exemplary embodiment, the maximum operation mode heating rate is substantially less than the maximum learning mode heating rate when it is lower than 50% of the maximum learning mode heating rate. Other definitions of the maximum operation mode heating rate being substantially less than the maximum learning mode heating rate are also possible.

The cooling effects seen at one or both sensors can also be used to further verify the correct performance of water heater. For example, by using the maximum cooling rate of the upper tank sensor versus the lower sensor, the controller can determine an improperly installed or broken dip-tube in the heater. If the cooling rate of the upper sensor far exceeds that of the lower sensor (before the tank has used most of its capacity), then the condition can be detected. The thresholds for this measurement can be learned in a similar fashion as the heating rate data, or can be preprogrammed into controller memory.

In an alternative embodiment, the cooling effects of ambient temperatures lower than those of the heated water on the heated water in the water tank 102 can be used in determining what difference between the maximum operation mode heating rate and the maximum learning mode heating would render the maximum operation mode heating rate substantially less than the maximum learning mode heating rate. Use of ambient temperature in such a way can be referred to as applying ambient temperature compensation. Ambient temperature compensation may be necessary if the insulation of the water heater is poor, or the heating capability is very low. Ambient temperature compensation may be accomplished in a number of ways. In one embodiment, a processing unit 202 with an internal, on chip temperature sensor (such as Texas Instruments MSP430F1132 microcontroller) can determine the temperature of the ambient air outside the water heater 100 and, using that ambient temperature, determine whether ambient temperature compensation should be applied to the calculation of whether the maximum operation mode heating rate is substantially less than the maximum learning mode heating rate.

In another alternative embodiment, the cooling rate of the water in the water tank 102 could be used to determine whether ambient temperature compensation should be applied. The cooling rate could be determined using the temperature sensors 206 and 208 in much the same way that the heating rate is calculated, as described above, when the main valve of the water heater 100 is off and there is no water draw (i.e., water flowing from the water heater). The cooling rate is preferably determined at about the same water temperature at which the heating rate is calculated. By way of example, if the ambient temperature were determined to be especially cold, and the water in the water tank 102 therefore cooled more quickly (or failed to heat as quickly), the maximum operation mode heating rate for that time cycle could be determined to not be substantially less than the maximum learning mode heating rate, even though it would have been considered to be substantially lower in warmer ambient temperature conditions.

In addition to ambient temperature compensation, maximum heating rate history compensation could be applied in determining whether the maximum operation mode heating rate is substantially less than the maximum learning mode heating rate. Maximum heating rate history compensation could be applied using a stored history of maximum operation mode heating rates in the history data 222. This data could be accessed by the processor and considered to determine whether any seasonal compensation should be applied in determining whether the maximum operation mode heating rate for any one time cycle is substantially less than the maximum learning mode heating rate.

Alternatively, if the processing unit 202 determines that the maximum operation mode heating rate is not substantially less than the maximum learning mode heating rate, the processing unit 202, at step 424, can delete the heating rates stored in the operation mode data 220 and the process can return to step 400 of FIG. 4A.

Conclusion

Prior attempts to monitor the performance of a water heater have typically involved detection and warning systems that use only single heat rate reading to determine whether the water heater is functioning optimally. The water heater performance monitoring system of the present invention, however, provides for a detection and warning system that uses the maximum heating rate from a plurality of heating rate measurements taken over a time cycle, such as two weeks, to determine whether the water heater is functioning properly. This approach allows temporary factors that affect the heating rate of water in a water heater to be filtered out, thereby decreasing the possibility of false alarms that could result in unnecessary service expenses. Further, this water heater monitoring device allows ambient temperature and seasonal compensation to further improve the accuracy of the device.

An exemplary embodiment of the present invention has been described above. Those skilled in the art will understand, however, that changes and modifications may be made to this embodiment without departing from the true scope and spirit of the present invention, which is defined by the claims.

What is claimed is:

1. A performance monitoring device for a water heater comprising:

a processing unit;

a temperature sensing apparatus;

an output device;

data storage;

a threshold heating rate stored in the data storage;

maximum heating rate data stored in the data storage, the maximum heating rate data comprising a maximum heating rate for a defined operation period from a plurality of calculated heating rates for the water heater; and monitoring logic stored in the data storage and executable by the processing unit to (i) monitor the heating rate of water in the water heater, (ii) make a determination whether the performance of the water heater has degraded and, in response to a determination of degradation, (iii) notify a user of the water heater of the degradation in performance;

wherein the determination whether the performance of the water heater has degraded includes a comparison of the maximum heating rate to the threshold heating rate.

2. The performance monitoring device of claim 1 wherein the water heater is a gas water heater.

3. The performance monitoring device of claim 1 wherein the temperature sensing apparatus comprises a first temperature sensor and a second temperature sensor.

4. The performance monitoring device of claim 3 wherein the first temperature sensor and the second temperature sensor are thermistor-type temperature sensors.

5. The performance monitoring device of claim 1 wherein the output device comprises at least one of a speaker, a liquid crystal display (LCD), and a light emitting diode (LED).

6. The performance monitoring device of claim 1 wherein the threshold heating rate is calculated using a maximum of a plurality of determined heating rates for water in the water heater during a learning mode of operation for the performance monitoring device.

7. The performance monitoring device of claim 1 wherein the threshold heating rate is defined.

8. The performance monitoring device of claim 1 wherein the defined operation period is two weeks.

9. A performance monitoring system comprising:

a water heater; and a performance monitoring device comprising:

a processing unit;

a temperature sensing apparatus;

an output device;

data storage;

a threshold heating rate stored in the data storage;

maximum heating rate data stored in the data storage, the maximum heating rate data comprising a maximum heating rate for a defined operation period from a plurality of calculated heating rates for the water heater; and monitoring logic stored in the data storage and executable by the processing unit to (i) monitor the heating rate of water in the water heater, (ii) make a determination whether the performance of the water heater has degraded and, in response to a determination of degradation, (iii) notify a user of the water heater of the degradation in performance;

wherein the determination whether the performance of the water heater has degraded includes a comparison of the threshold heating rate and the maximum heating rate.

10. The performance monitoring system of claim 9 wherein the water heater is a gas water heater.

11. The performance monitoring system of claim 9 wherein the temperature sensing apparatus comprises a first temperature sensor and a second temperature sensor.

12. The performance monitoring system of claim 11 wherein the first temperature sensor and the second temperature sensor are thermistor-type temperature sensors.

13. The performance monitoring system of claim 11 wherein the water heater has a top end and a bottom end and the first temperature sensor is located near the top end of the water heater and the second temperature sensor is located near the bottom end of the water heater.

14. The performance monitoring system of claim 9 wherein the output device comprises one of a speaker, a liquid crystal display (LCD), and a light emitting diode (LED).

15. The performance monitoring system of claiin 9 wherein the threshold heating rate is calculated using a maximum of a plurality of determined heating rates for water in the water heater during a learning mode of operation for the performance monitoring device.

16. The performance monitoring system of claim 9 wherein the threshold heating rate is defined.

17. The performance monitoring system of claim 9 wherein the defined operation period is two weeks.

18. A method of monitoring the performance of a water heater, the method comprising:

determining a maximum heating rate for water in the tank of the water heater, wherein the maximum heating rate is determined from a plurality of heating rates calculated from measurements, each measurement separated by a time cycle during an operation period;

determining if the performance of the water heater during the operation period is degraded relative to a threshold heating rate for the water heater by comparing the maximum heating rate to the threshold heating rate; and in response to the determination of degradation, alerting a user of the water heater regarding the degradation in the performance of the water heater.

19. The method of claim 18 wherein the threshold heating rate is calculated using a plurality of heating rates for the water in the water heater during a learning period, wherein the learning period occurs before the operation period.

20. The method of claim 19 wherein determining each of the plurality of heating rates includes the steps of (1) measuring a water temperature at a first time and (2) measuring a second water temperature at a second time after the first time.

21. The method of claim 19 wherein the learning period is two weeks.

22. The method of claim 18 wherein the threshold heating rate is a preset rate.

23. The method of claim 18 wherein the maximum heating rate is substantially Less than the threshold heating rate if the maximum heating rate is less than 50% of the threshold heating rate.

24. The method of claim 23 wherein if the maximum heating rate is substantially less than the threshold heating rate, the performance of the water heater has been sufficiently degraded.

25. The method of claim 18 where the operation period is two weeks.

26. The method of claim 18, wherein the water heater is a gas water heater.

27. The method of claim 18, wherein the time cycle is one minute.

* * * * *